US009486661B2

(12) United States Patent
Thomson

(10) Patent No.: US 9,486,661 B2
(45) Date of Patent: Nov. 8, 2016

(54) EXERCISE SWING

(75) Inventor: Wendy Thomson, Yarmouth (GB)

(73) Assignee: Wendy Thomson, Yarmouth (GB)

( * ) Notice: Subject to any disclaimer, the term of this patent is extended or adjusted under 35 U.S.C. 154(b) by 28 days.

(21) Appl. No.: 13/698,270

(22) PCT Filed: May 16, 2011

(86) PCT No.: PCT/GB2011/050929

§ 371 (c)(1),
(2), (4) Date: Jan. 15, 2013

(87) PCT Pub. No.: WO2011/144925

PCT Pub. Date: Nov. 24, 2011

(65) Prior Publication Data

US 2013/0203559 A1 Aug. 8, 2013

(30) Foreign Application Priority Data

May 15, 2010 (GB) ..... 1008156.0

(51) Int. Cl.

*A63B 21/04* (2006.01)
*A63B 21/00* (2006.01)
*A63B 24/00* (2006.01)
(Continued)

(52) U.S. Cl.

CPC ..... *A63B 21/0442* (2013.01); *A63B 7/00* (2013.01); *A63B 21/00069* (2013.01); *A63B 21/015* (2013.01); *A63B 21/4047* (2015.10); *A63B 24/00* (2013.01); *A63B 71/0619* (2013.01); *A63B 2071/0081* (2013.01); *A63B 2220/17* (2013.01); *A63B 2220/56* (2013.01); *A63B 2220/805* (2013.01); *A63B 2230/06* (2013.01)

(58) Field of Classification Search

CPC ..... A63B 21/0442; A63B 21/00069; A63B 21/015; A63B 21/1492; A63B 7/00; A63B 7/02; A63B 2220/17; A63B 2220/56; A63B 2220/805; A63B 9/00; A63B 9/22

USPC ..... 482/1, 8, 23, 33, 35, 114, 119, 142, 482/143, 148

See application file for complete search history.

(56) References Cited

U.S. PATENT DOCUMENTS 2,852,067 A 9/1958 Manocchia
4,377,281 A 3/1983 Jesernig et al.
(Continued)

FOREIGN PATENT DOCUMENTS

CN 201216838 Y 4/2009
DE 52176 5/1890
(Continued)

OTHER PUBLICATIONS

GB Search Report dated Mar. 18, 2011 for GB patent application No. 1008156.0, 2 pages.
(Continued)

*Primary Examiner* — Sandhara Ganesan
(74) *Attorney, Agent, or Firm* — Lee & Hayes, PLLC

(57) ABSTRACT

An exercise swing comprising: a seat; an axle; at least one swingable member having a first end attached to said seat and a second end connected via a pivot to said axle; and a resistance adjuster for varying the resistance of said pivot to back-and-forth swinging motion of the swingable member about the pivot, and the exercise swing arranged so as to allow the entire body of a user, with the user seated on the seat, to swing back-and-forth through an arcuate path.

13 Claims, 1 Drawing Sheet

(51) Int. Cl.

| | |
|---|---|
| ***A63B 21/015*** | (2006.01) |
| ***A63B 7/00*** | (2006.01) |
| *A63B 71/00* | (2006.01) |
| *A63B 71/06* | (2006.01) |

(56) References Cited

U.S. PATENT DOCUMENTS

| | | | | |
|---|---|---|---|---|
| 5,054,771 | A | 10/1991 | Mansfield | |
| 5,603,678 | A | 2/1997 | Wilson | |
| 5,626,548 | A | 5/1997 | Coyle | |
| 7,125,371 | B2 * | 10/2006 | Henderson | 482/142 |
| 2003/0022772 | A1 | 1/2003 | Stearns | |
| 2003/0050155 | A1 | 3/2003 | Lat | |
| 2005/0049055 | A1 * | 3/2005 | Publicover et al. | 472/118 |
| 2005/0272576 | A1 | 12/2005 | Simmons | |
| 2006/0252566 | A1 * | 11/2006 | Gibree | 472/118 |
| 2008/0072942 | A1 * | 3/2008 | Warren | 135/67 |
| 2010/0261591 | A1 * | 10/2010 | Piane, Jr. | 482/143 |

FOREIGN PATENT DOCUMENTS

| | | |
|---|---|---|
| DE | 202005005394 | 8/2005 |
| GB | 283452 | 1/1928 |
| GB | 2382035 A | 5/2003 |
| WO | WO2009/004645 | 1/2009 |

OTHER PUBLICATIONS

PCT Search Report mailed Jul. 19, 2011 for PCT application No. PCT/GB2011/050929, 4 pgs.

* cited by examiner

EXERCISE SWING

CROSS REFERENCE TO RELATED APPLICATIONS

The present disclosure is a national stage application of and claims priority to international patent application PCT/GB2011/050929, filed on May 16, 2011, now International Publication No. WO 2011/144925, issued Nov. 24, 2011, which claims priority from Great Britain Patent Application No. 1008156, filed May 15, 2010, which applications are hereby incorporation in their entireties by reference.

TECHNICAL FIELD

The present invention relates generally to exercise swings and in particular, although not exclusively, to swings for use in rehabilitation.

BACKGROUND

We have appreciated that there is a need for an improved exercise swing and that it would be advantageous to have an exercise swing designed for rehabilitation of particular muscles in a gentle manner after injury.

SUMMARY

According to one aspect of the invention there is provided an exercise swing comprising: a seat; an axle; at least one swingable member having a first end attached to said seat and a second end connected via a pivot to said axle; and a resistance adjuster for varying the resistance of said pivot to back-and-forth swinging motion of the swingable member about the pivot, and the exercise swing arranged so as to allow the entire body of a user, with the user seated on the seat, to swing back-and-forth through an arcuate path.

In one embodiment of the invention there is provided a swing for exercise after trauma or injury which enables a user to perform controlled gentle exercise which can speed recovery.

An advantage of an embodiment of the present invention is that a user can determine the resistance of the swing and therefore the difficulty of the exercise. A further advantage is that the full seat with back, arm and leg rests provides support and comfort to a rehabilitating user. A yet further advantage is that the device tracks the progress of the user by recording and/or displaying the resistance, number of swings, and other relevant details.

BRIEF DESCRIPTION OF THE DRAWINGS

Various embodiments of the invention will now be described, by way of example only, with reference to the following drawings, in which.

DETAILED DESCRIPTION

Figure 1:
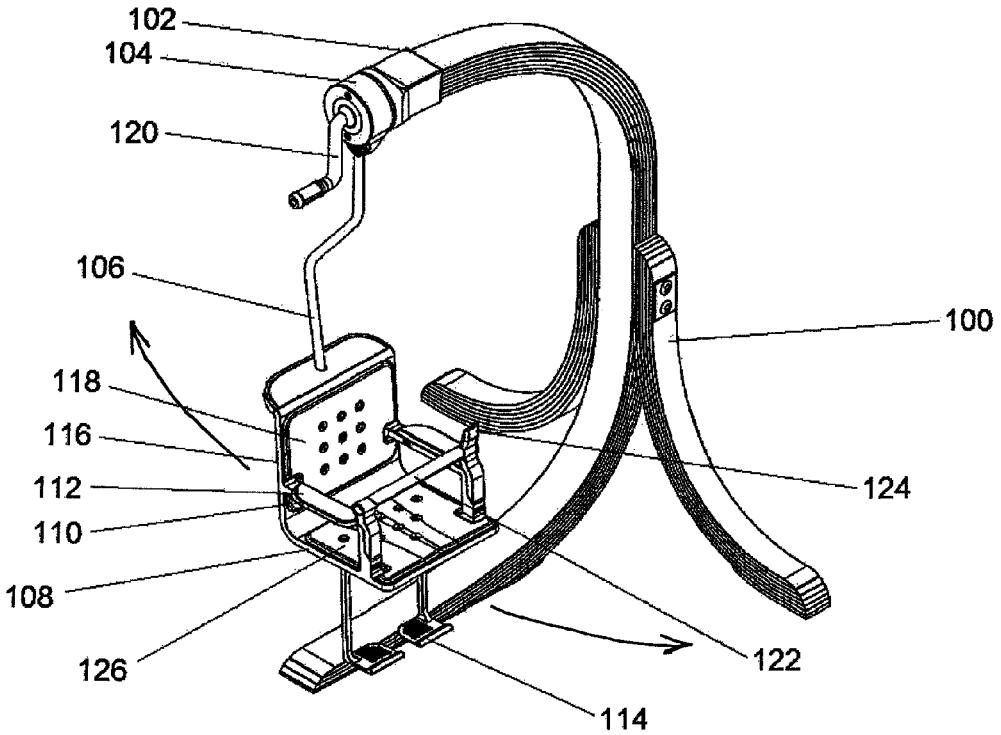
FIG. 1 shows an exercise swing.

In a preferred embodiment of the invention, shown in FIG. 1, an exercise swing is disclosed comprising: a seat 108; an axle 102; a swingable member 106 having a first end attached to said seat and a second end connected via a pivot 104 to said axle; and a resistance adjuster for varying the resistance of said pivot.

The swing is intended for use by one recovering from injury or physical trauma. This is at least in part achieved by firstly by having a variable resistance as described below, and secondly by having a supportive seat as described below.

The axle may be an aluminum or steel tube or the like, or may be a wooden member, or other suitable material, and is preferably supported by a frame 100 which is preferably shaped as shown in the figures although it may be any shape, such as the traditional symmetrical shape of a horizontal axle supported on two inverted V's. The axle may alternatively be mounted on a wall or suspended from a ceiling or otherwise independent of any frame. The axle may support the swingable member in one or more locations and may support multiple swingable members if present, in the same or different locations along the axle. The axle may be an elongate member but may also be a point strong enough to support the swingable member and seat. It is envisaged that the axle be disposed substantially vertically above the seat although it may be offset to one side of the seat and may even be disposed at the same height as the seat or below the seat, with a non-straight swinging member. Essentially, the axle may be any component which pivotally supports the swingable member and thereby the seat.

The swingable member may be an aluminum or steel tube or the like, or may be a wooden member, or other suitable material, and is preferably shaped as shown in the Figures to support the seat. The defining features of the swingable member are that it comprises two ends: a first end which is attached to the seat, and a second end which is connected via a pivot to the axle; that it thereby supports the seat while enabling oscillatory motion, in this case a "free" swinging motion in which the user moves back-and-forth about the pivot as shown by the arrows in FIG. 1; and that it is substantially rigid to enable the swing resistance to be varied. During the swinging motion the entire body of the user is moved through the arcuate path in the frame of reference of the swingable member. The propulsive force is generated by the user adjusting his body centre of mass (by raising and lowering legs and moving/pivoting the upper body) in synchronization with the swing movement. The angular extent of the swinging motion about and to each side of the central vertical position (which is that shown in FIG. 1) is typically up to around 45°, although more generally may be in the region 30° to 70°, to each side of the central position.

The seat comprises a surface on which a user can sit and may comprise any material able to support a user. Preferably the seat comprises a support for supporting a user and is shaped as shown in the figures, to fully support a user recovering from injury.

The support preferably comprises all, and may comprise any, of the following: arm rests; fixed leg rests; adjustable leg rests; back rest.

The back rest 116 is preferably shaped as shown in FIG. 1 and its angle may be adjustable to provide comfort.

The arm rests 110 are preferably as shown in FIG. 1 and may comprise a height or angle adjuster as known in the art. An advantage of adjusting the height of the arm rests is that the apparatus can be adapted to users of different lengths of arms. An advantage of adjusting the angle of the arms rests is that it enables users with restricted arm motion to use the apparatus.

The leg rests 114 are preferably as shown in FIG. 1 and comprise length and angle adjusting means as known in the art. An advantage of adjusting the angle of the leg rests is that the position of the legs can be adjusted for one unable to raise the legs unaided, to assist swinging, for example to enable a user to push off from a wall to increase swinging amplitude.

An advantage of adjusting the length of the leg rests is that the apparatus can be adapted to users of different heights.

Preferably all, and alternatively any, of the above support means comprise padding, which may be fixed or removable, to increase user comfort. The padding may comprise foam or other soft material as known in the art. FIG. 1 shows seat padding 126, back rest padding 118, and arm rest padding 112.

The support preferably further comprises a safety barrier 122 for preventing a user from falling out of the seat. The safety barrier may comprise a bar as shown in FIG. 1 which preferably opens and closes to allow access, or may comprise any safety barrier known in the art.

The safety barrier preferably comprises a sensor for detecting when a user falls forwards. This may be a pressure sensor for detecting the weight of the user, disposed on the bar, or a light sensor for detecting when a user covers the bar, or any other sensing means. It is advantageous to have such a safety feature since users may have a low level of physical ability and be unable to recover themselves from this position, especially while swinging. The sensor may stop the motion of the swing, and/or may sound an alarm.

Preferably, the resistance adjuster comprises a rubber clamp having two pads, one on each side of the swingable member—that is, a first pad on a first side of said swingable member and a second pad on a second side of said swingable member so as to "clamp" the swingable member therebetween. The pads preferably comprise rubber although they may comprise other suitable materials as known in the art, and grip the swingable member to provide friction against the oscillatory motion of the swing in the plane of the oscillatory motion. A handle 120 is preferably provided which is connected to the clamp such that turning the handle manually brings the clamps closer together or further apart, thereby tightening and loosening the clamp and so adjusting the resistance to the oscillatory movement. An advantage of this is that a user can feel the resistance when tightening and gauge the difficulty of the level of resistance being set. Alternatively, buttons or dials may be provided whereby the resistance can be adjusted digitally via a servo or driven device, or the like. Furthermore a caliper brake design may be used to grip the swingable member and provide resistance. A lever, handle or other means may be provided to vary the resistance.

It will be readily understood that there are many ways of varying the resistance of such a swing and any such means may be used. The resistance adjuster may comprise dampeners, springs, elastic members, weights, or any combination of the above or other means. The resistance adjuster may comprise an electromagnetic impedance device. The resistance adjuster may alternatively comprise a microprocessor controlled torque resister, being pneumatic, hydraulic or electromagnetic impedance enabled. The resistance adjuster preferably comprises a manual handle as stated above.

The resistance of the swing is preferably variable between substantially zero resistance, which is ideal for one beginning to use extremely weak muscles, and a high resistance which is suitable for one building up normal strength. The swing may be able to provide a resistance high enough to tone muscles to athletic levels for use in sports training.

The swing preferably further comprises a recorder for recording swing data; and a display for displaying said data.

The recorder may be any counter, timer, sensor or the like as known in the art for this purpose, and preferably records. Preferably a pressure sensor and a motion sensor (swing sensor) are disposed near or in association with the pivot to provide data feedback. The pressure sensor senses the swing resistance and sends a signal via a PCB or the like to the data display. The motion sensor senses the motion of the swing and counts the number of swings, sending a signal by similar means to the data display. Sensors may be disposed in the safety barrier for sensing a pulse. These send a signal to the data display to display a heart rate. The display may also display calories burned, which may be calculated as a function of distance moved, swing resistance, and/or any other factors as known in the art. The data display may also show any other data.

Figure 2:
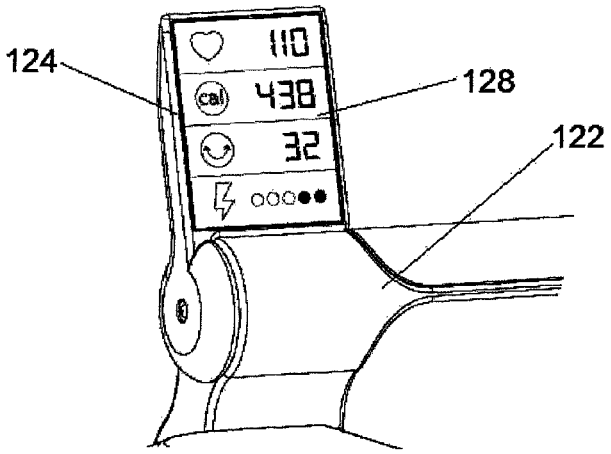
FIG. 2 shows an example of a data display.

As shown in FIG. 2, the data display is preferably a monitor 124, and may comprise an LED display, LCD screen, touch screen, plasma screen or any screen 128 known in the art. Furthermore it may be an analogue screen comprising dials or any display known in the art. The screen is preferably removable and is preferably contained in a separate monitor unit which is independently rechargeable from the mains as known in the art. Preferably the monitor unit clips, slots, or otherwise attaches removably to the seat, arm rest or safety barrier as shown in FIG. 2 such that a user can view it while swinging.

Although the swing has particular application in the field of rehabilitation, as alluded to above, it can also be used as an exercise device for fitness. In both applications, the swing can effect a non-weight bearing whole body exercise, whilst the user experiences the enjoyable swinging motion.

What is claimed is:

1. An exercise swing comprising:

a seat;

an axle;

at least one swingable member having a first end attached to said seat and a second end connected via a pivot to said axle; and a resistance adjuster for varying the resistance of said pivot to back-and-forth swinging motion of the swingable member about the pivot while allowing the swinging motion during application of the resistance, wherein the resistance adjuster comprises at least one of (i) a hydraulic enabled resistance adjuster or (ii) an electromagnetic impedance enabled resistance adjuster, wherein the exercise swing is arranged so as to allow the entire body of a user, with the user seated on the seat, to swing back-and-forth through an arcuate path, and wherein the seat is arranged to swing to each side of a central vertical position.

2. An exercise swing as claimed in claim 1 in which the resistance adjuster arranged to apply a user-settable resistance force to the swingable member.

3. An exercise swing as claimed in claim 2 in which the resistance adjuster comprises a clamp which allows a user-settable clamping force to be applied to the second end of the swingable member.

4. The exercise swing of claim 3 wherein said resistance adjuster comprises:

a rubber clamp having a first pad on a first side of said swingable member and a second pad on a second side of said swingable member; and a handle.

5. The exercise swing of claim 1 arranged to allow the user to bring about the swinging motion by way of movement of the user's center of mass.

6. The exercise swing of claim 5 provided with an underlying region to allow the user to freely move his lower leg regions during swinging.

7. The exercise swing of claim 1 wherein said seat comprises a user support.

8. The exercise swing of claim 7 wherein said user support comprises at least one selected from the list comprising: arm rests; fixed leg rests; adjustable leg rests; seat padding; back rest; back rest padding.

9. The exercise swing of claim 1 further comprising a safety barrier for preventing a user from falling forwards out of the seat.

10. The exercise swing of claim 9 wherein said safety barrier comprises a sensor for detecting when a user falls forwards.

11. The exercise swing of claim 1 further comprising: a recorder for recording swing data; and a display for displaying said data.

12. The exercise swing of claim 11 wherein said display for displaying said data comprises a removable monitor.

13. The exercise swing of claim 12 wherein said monitor is rechargeable independently of said swing.

* * * * *